US010116064B2

(12) United States Patent
Hu et al.

(10) Patent No.: US 10,116,064 B2
(45) Date of Patent: Oct. 30, 2018

(54) MILLIMETER-WAVE ANTENNA DEVICE AND MILLIMETER-WAVE ANTENNA ARRAY DEVICE THEREOF

(71) Applicant: NATIONAL CHUNG SHAN INSTITUTE OF SCIENCE AND TECHNOLOGY, Taoyuan (TW)

(72) Inventors: Cheng-Nan Hu, New Taipei (TW); Der-Phone Lin, Taoyuan (TW)

(73) Assignee: NATIONAL CHUNG SHAN INSTITUTE OF SCIENCE AND TECHNOLOGY (TW)

( * ) Notice: Subject to any disclaimer, the term of this patent is extended or adjusted under 35 U.S.C. 154(b) by 254 days.

(21) Appl. No.: 15/044,234

(22) Filed: Feb. 16, 2016

(65) Prior Publication Data

US 2017/0237178 A1 Aug. 17, 2017

(51) Int. Cl.

| | |
|---|---|
| ***H01Q 21/00*** | (2006.01) |
| ***H01Q 9/06*** | (2006.01) |
| ***H01Q 21/06*** | (2006.01) |
| *H01Q 3/26* | (2006.01) |

(52) U.S. Cl.
CPC ..... *H01Q 21/0025* (2013.01); *H01Q 21/064* (2013.01); *H01Q 3/26* (2013.01)

(58) Field of Classification Search
CPC ..... H01Q 21/0025; H01Q 21/064; H01Q 3/26
See application file for complete search history.

(56) References Cited

U.S. PATENT DOCUMENTS

| | | | | |
|---|---|---|---|---|
| 8,242,966 | B2 | 8/2012 | Liu | |
| 8,901,688 | B2 | 12/2014 | Kamgaing | |
| 2012/0146869 | A1* | 6/2012 | Holland | H01Q 21/061 343/795 |
| 2013/0321228 | A1 | 12/2013 | Crockett, Jr. et al. | |
| 2014/0333480 | A1 | 11/2014 | Kamgaing et al. | |

* cited by examiner

*Primary Examiner* — Jessica Han
*Assistant Examiner* — Michael Bouizza
(74) *Attorney, Agent, or Firm* — Schmeiser, Olsen & Watts, LLP

(57) ABSTRACT

A millimeter-wave antenna device and a millimeter-wave antenna array device thereof are characterized in that bump portions on coaxial cable connector bases protrude into through holes of a millimeter-wave substrate to effectuate fixation thereof and ensure that the millimeter-wave substrate is tightly coupled to the coaxial cable connector bases to not only ensure the precision of the position of a feed impedance unit of a microstrip antenna structure but also ensure that, when fixed to an antenna back panel frame, a triangular configuration is effectuated such that larger antenna spacing (i.e., 8.5~12 mm) is achieved while meeting the functional requirement of an antenna beam scan, that is, an allowance of ±30 degrees approximately, thereby circumventing a problem, i.e., the spacing between antenna units is too small to enable an external emitting/receiving module to function.

8 Claims, 7 Drawing Sheets

MILLIMETER-WAVE ANTENNA DEVICE AND MILLIMETER-WAVE ANTENNA ARRAY DEVICE THEREOF

FIELD OF THE INVENTION

The present invention relates to antenna devices and, more particularly, to a millimeter-wave antenna device and a millimeter-wave antenna array device thereof.

BACKGROUND OF THE INVENTION

Millimeter-wave, also known as mm-wave for short, is electromagnetic wave with frequencies which fall between those of microwave and light wave. In general, millimeter-wave features frequencies of 30~300 GHz and wavelengths of 1~10 mm. Millimeter-wave provides broadband. Due to information explosion, data streams are ever-increasing in a manner that data streams beyond 4 G (B4G) will increase 1000 times by year 2020 and 10,000 times by year 2025. In view of this, the technology about the transmission of millimeter-wave is regarded as crucial to the capability of transmitting data streams at high flow rates and thus plays an important role in the development of B4G communication technology and even 5G communication technology.

Referring to FIG. 1*a*, the prior art about a glass-based high-performance 60 GHZ/millimeter-wave phase array antenna is disclosed by U.S. Pat. No. 8,901,688 issued on Dec. 2, 2014. The millimeter-wave phase array antenna comprises cavities 11 disposed in a phased-array antenna (PAA) substrate 10. The cavities 11 are disposed below planar antenna elements (12, 13). Emitter traces 14 are disposed on the PAA substrate opposite the planar antenna elements (12, 13) and the emitter traces 14, the cavities 11 and the planar antenna elements (12, 13) are vertically aligned. The aforesaid structural arrangement requires precise vertical alignment of the cavities 11 and the planar antenna elements (12, 13) to the detriment of the configuration of an RFIC die 15 of a through-silicon via (TSV) 16 and the TSV 16; as a result, not only higher costs are incurred, but, however mild, an error also leads to transmission loss.

Referring to FIG. 1*b*, an active electronically scanned array antenna is disclosed in US2013/0321228 published on Dec. 5, 2013. The active electronically scanned array antenna comprises a body 21. Circular holes 25 defined on the body 21 are aligned with circulators 22, respectively. The body 21 is mounted on a radiator base 23 by a plurality of fastening elements, such as screws. Coaxial connectors 24 are coupled to predetermined an emission port and a receiving port of the body 21, thereby forming a radiator stick 20. The aforesaid assembly structure, however, is so complicated that imprecision of alignment, however mild, causes transmission loss.

Referring to FIG. 1*c*, a phased-array antenna is disclosed in US2014/0333480 published on Nov. 13, 2014. The phased-array antenna radio-frequency integrated-circuit chip apparatus 30 is disposed on a phased-antenna array base 32 and comprises planar antenna elements 31 which are arranged to form a rectangular pattern and spaced apart from each other. The aforesaid arrangement, however, renders the spacing between the antennas overly small to the detriment of the installation of an emitting/receiving module.

Referring to FIG. 1*d*, an antenna array is disclosed in U.S. Pat. No. 8,242,966 issued on August 14. The antenna array comprises an antenna 40. The antenna 40 comprises a first antenna unit 41, second antenna unit 42, third antenna unit 43 and fourth antenna unit 44 which are put together in a three-dimensional configuration. The aforesaid design, however, renders it difficult to mount an emitting/receiving module.

In view of the aforesaid drawbacks of the prior art, it is important to integrate antennas of a millimeter-wave array with reference to microwave integrated circuit design concepts but still achieve low signal transmission loss and meet the demand for commercialization and mass production. For instance, given a 5G communication system, antenna design requires that a beam scan comes with an allowance of +30 degrees or so. The requirement causes antenna spacing to fall within the range of 0.6λ~0.7λ (i.e., 4.7~5.5 mm); as a result, the small antenna spacing leads to two problems with waveguide millimeter-wave array antenna as follows: (1) the required precision of the waveguide antenna mechanism is too strict to carry out efficient production; (2 the spacing of waveguide antennas is too small to allow an external emitting/receiving module of K-connector or waveguide flange to function.

SUMMARY OF THE INVENTION

It is an objective of the present invention to enable a millimeter-wave antenna structure to incur low signal loss.

Another objective of the present invention is to enhance the mechanism precision of millimeter-wave antenna despite circuit-related physical size limitation.

Yet another objective of the present invention is to enable a waveguide antenna mechanism to operate in conjunction with an external emitting/receiving module.

In order to achieve the above and other objectives, the present invention provides a millimeter-wave antenna device, comprising: a millimeter-wave substrate with through holes penetrating disposed therein and aligned in a column direction and a microstrip antenna structure formed from two metal layers disposed on and below the millimeter-wave substrate, respectively; and a coaxial cable connector bases having a recess for holding a coaxial cable connector, wherein an internal conductor and an external conductor of the coaxial cable connector are exposed from an opening disposed at a bottom of the recess, and at least a bump portion is disposed at the coaxial cable connector bases and outside the opening of the recess; wherein, when a top surface of the coaxial cable connector bases is coupled to a bottom surface of the millimeter-wave substrate, the internal conductor and the external conductor which are exposed from the coaxial cable connector bases are electrically connected to the microstrip antenna structure, and the at least a bump portion protrudes into the through holes, respectively, to thereby fix the coaxial cable connector bases in place.

In an embodiment of the present invention, the at least a bump portion is in the number of two, and the millimeter-wave substrate has through holes corresponding in position to the two bump portions, respectively.

In an embodiment of the present invention, a metal layer at a middle region of the through holes and on an upper surface of the millimeter-wave substrate functions as a first metal layer of the microstrip antenna structure, and a ground plane is disposed on a lower surface of the millimeter-wave substrate in a manner to correspond in position to the lower region of the first metal layer so as to function as a second metal layer of the microstrip antenna structure.

In an embodiment of the present invention, when the top surface of the coaxial cable connector bases is coupled to the bottom surface of the millimeter-wave substrate, the internal conductor of each coaxial cable connector is inserted into the millimeter-wave substrate and thus electrically connected to the first metal layer, and the external conductor of each coaxial cable connector is electrically connected to the second metal layer.

In order to achieve the above and other objectives, the present invention further provides a millimeter-wave antenna array device, comprising: an antenna back panel frame having frame through holes adapted to hold coaxial cable connectors and arranged in columns in a manner that the frame through holes together with the spacing therebetween form a checkerboard-like pattern; and millimeter-wave antenna devices corresponding in position to the frame through holes, respectively, and arranged in columns, wherein the millimeter-wave antenna devices each comprise: a millimeter-wave substrate being a slender board extending in a column direction, with through holes penetratingly disposed in the millimeter-wave substrate and aligned in the column direction, and the millimeter-wave substrate comprises a plurality of microstrip antenna structures formed from metal layers disposed on the upper surface and the lower surface of the millimeter-wave substrate; and a plurality of coaxial cable connector bases each having a recess for holding a coaxial cable connector, wherein an internal conductor and an external conductor of the coaxial cable connector are exposed from an opening disposed at the bottom of the recess, wherein at least a bump portion is disposed at the coaxial cable connector bases and positioned outside the opening of the recess, wherein, when the top surface of the coaxial cable connector bases is coupled to the bottom surface of the millimeter-wave substrate, the coaxial cable connector bases are received in the frame through holes, respectively, disposed below the millimeter-wave substrate and aligned in the column direction such that the internal conductor and the external conductor, which are exposed from each coaxial cable connector base, are electrically connected to the microstrip antenna structure, and the at least a bump portion protrudes into the through holes, respectively, to thereby fix the coaxial cable connector bases in place.

In an embodiment of the present invention, the bump portions disposed at each coaxial cable connector base and positioned outside the opening of the recess are in the number of two, and millimeter-wave substrate has through holes which correspond in position to the two bump portions, respectively, wherein fixing elements are penetratingly disposed in through holes above and below two adjacent through holes corresponding in position to the two bump portions such that the millimeter-wave substrate is fixed to the antenna back panel frame.

In an embodiment of the present invention, a metal layer at a middle region of the through holes corresponding in position to the two bump portions and on the upper surface of the millimeter-wave substrate functions as a first metal layer of the microstrip antenna structure, and a ground plane is disposed on the lower surface of the millimeter-wave substrate in a manner to correspond in position to the lower region of the first metal layer so as to function as a second metal layer of the microstrip antenna structure.

In an embodiment of the present invention, when the top surface of the coaxial cable connector bases is coupled to a bottom surface of the millimeter-wave substrate, the internal conductor of each coaxial cable connector is inserted into the millimeter-wave substrate and thus electrically connected to the first metal layer, and the external conductor of each coaxial cable connector is electrically connected to the second metal layer.

Therefore, the present invention is characterized in that a millimeter-wave substrate is tightly coupled to coaxial cable connector bases to not only ensure the precision of the position of a feed impedance unit of a microstrip antenna structure but also ensure that, when fixed to an antenna back panel frame, the present invention puts forth a triangular configuration whereby larger antenna spacing (i.e., 8.5~12 mm) is achieved while meeting the functional requirement of an antenna beam scan, that is, an allowance of ±30 degrees or so; hence, the present invention overcomes a drawback of the prior art, that is, the spacing of waveguide antennas is too small to enable an external emitting/receiving module to function.

BRIEF DESCRIPTION OF THE DRAWINGS

Objectives, features, and advantages of the present invention are hereunder illustrated with specific embodiments in conjunction with the accompanying drawings, in which.

DETAILED DESCRIPTION OF THE PREFERRED EMBODIMENTS

Figure 1A:
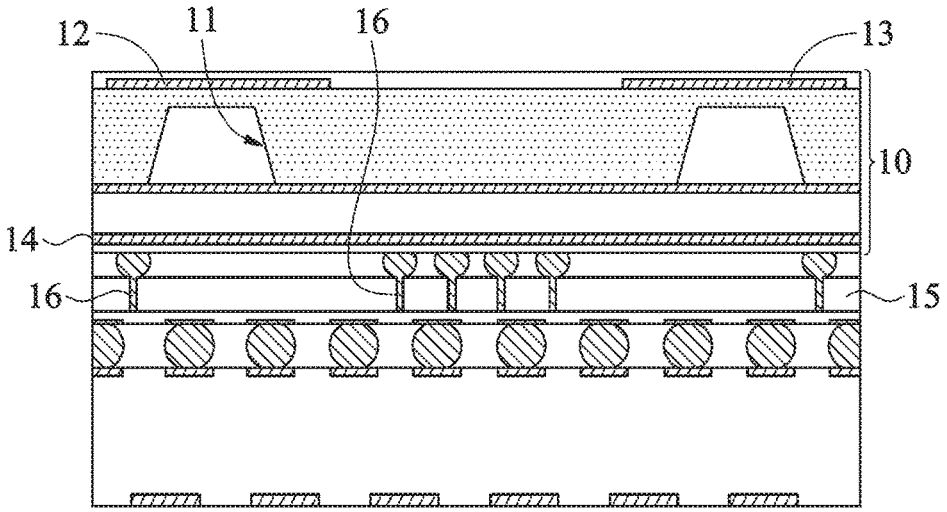
FIG. 1a (PRIOR ART)
FIG. 1*a* (PRIOR ART) is a schematic view of U.S. Pat. No. 8,901,688.
Figure 1B:
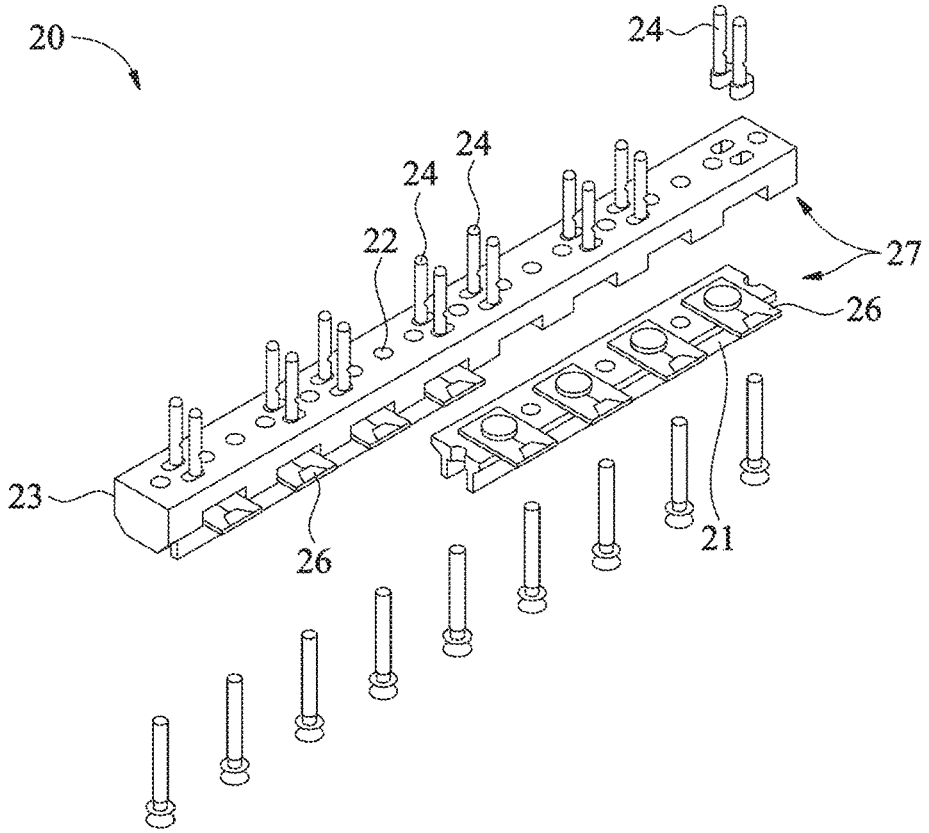
FIG. 1b (PRIOR ART)
FIG. 1*b* (PRIOR ART) is a schematic view of US2013/0321228.
Figure 1C:
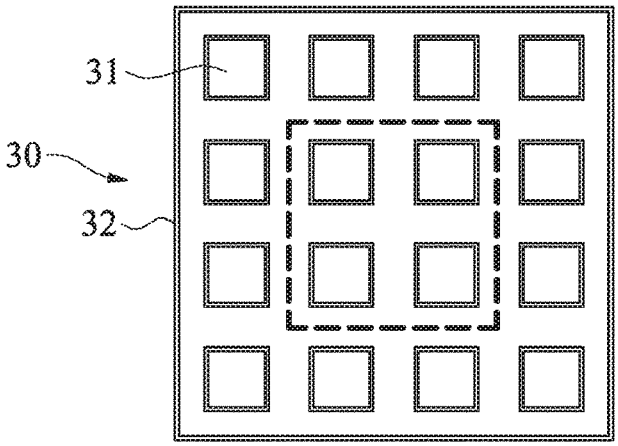
FIG. 1c (PRIOR ART)
FIG. 1*c* (PRIOR ART) is a schematic view of US2014/0333480.
Figure 1D:
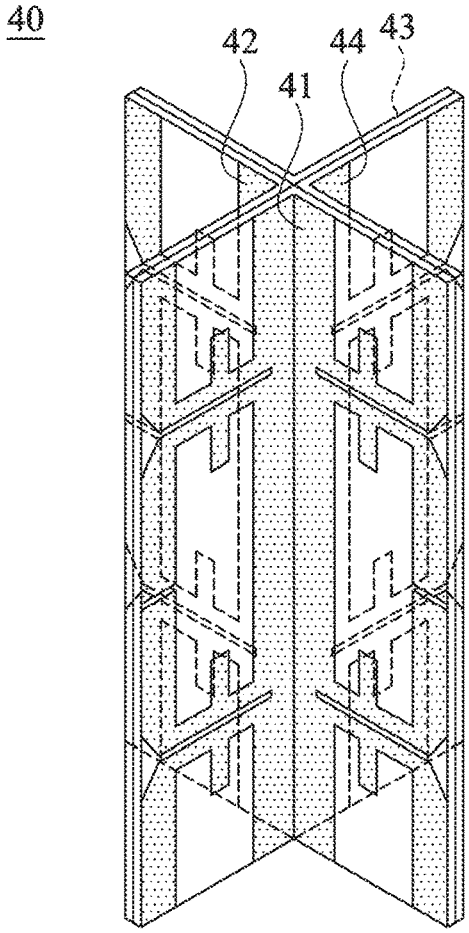
FIG. 1d (PRIOR ART)
FIG. 1*d* (PRIOR ART) is a schematic view of U.S. Pat. No. 8,242,966.
Figure 2:
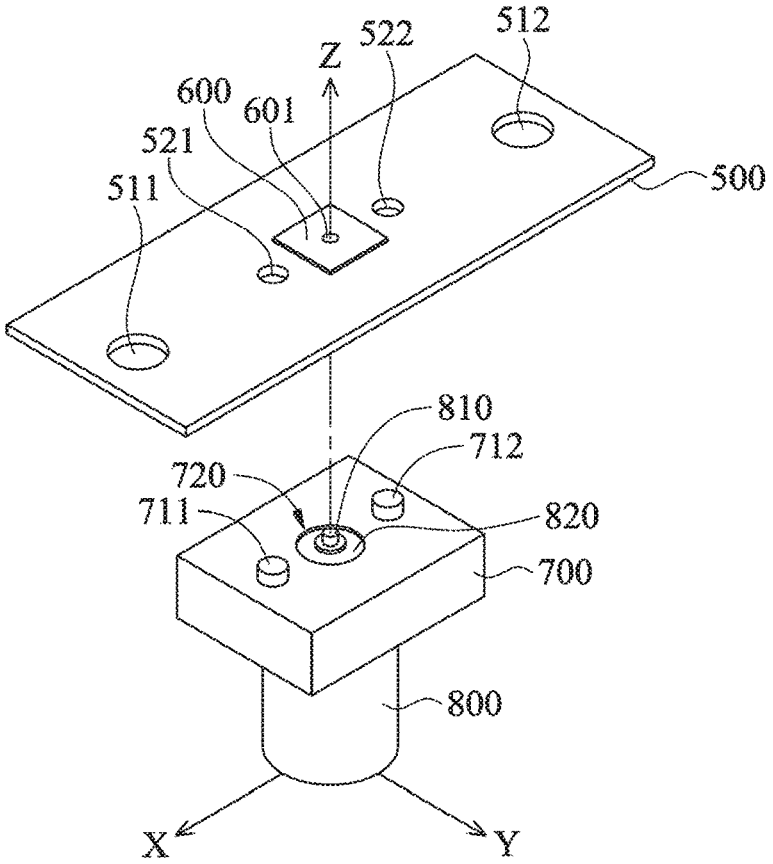
FIG. 2 is an exploded view of a millimeter-wave antenna device according to an embodiment of the present invention.
Figure 3:
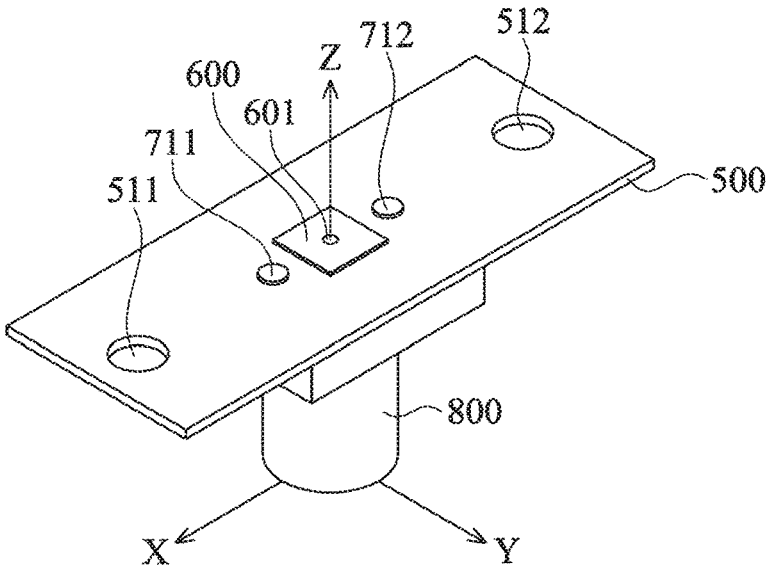
FIG. 3 is a schematic view of the millimeter-wave antenna device assembled in a manner illustrated with FIG. 2 according to the embodiment of the present invention.

FIG. 2 is an exploded view of a millimeter-wave antenna device according to an embodiment of the present invention. FIG. 3 is a schematic view of the millimeter-wave antenna device assembled in a manner illustrated with FIG. 2 according to the embodiment of the present invention.

Referring to FIGS. 2, 3, a millimeter-wave antenna device comprises a millimeter-wave substrate 500 and coaxial cable connector bases 700. Through holes 511, 512, 521, 522 are penetratingly disposed in the millimeter-wave substrate 500 and aligned in the column direction. The millimeter-wave substrate 500 comprises a metal layer 600 and an opposing metal layer (not shown) which are disposed on and below the millimeter-wave substrate 500, respectively.

The coaxial cable connector bases 700 each have a recess 720 for holding a coaxial cable connector 800. An internal conductor 810 and an external conductor 820 of the coaxial cable connector 800 are exposed from an opening disposed at the bottom of the recess 720. At least a bump portion 711, 712 is disposed at the coaxial cable connector bases 700 and positioned outside the opening of the recess 720. The embodiment illustrated with FIGS. 2, 3 is exemplified by two bump portions 711, 712.

When the top surface of the coaxial cable connector bases 700 is coupled to the bottom surface of the millimeter-wave substrate 500, the internal conductor 810 and the external conductor 820 of the coaxial cable connector 800, which are exposed from the coaxial cable connector bases 700, are electrically connected to the microstrip antenna structure, and the two bump portions 711, 712 protrude into the through holes 521, 522, respectively, to thereby fix the coaxial cable connector bases in place. The through holes 511, 512 enable the millimeter-wave substrate 500 to be fixed to any other plate; for example, the millimeter-wave substrate 500 is fixed to a plate frame by a fastening element, such as a screw.

A metal layer of a radiating metal plate with a square or rectangular shape is printed, by screen printing or etching, at the middle region of the through holes 521, 522 and on the upper surface of the millimeter-wave substrate 500 to function as a first metal layer 600 of the microstrip antenna structure. A ground plane with a square or rectangular shape is printed, by screen printing or etching, on the lower surface of the millimeter-wave substrate 500 in a manner to correspond in position to the lower region of the first metal layer 600 such that the ground plane functions as a second metal layer. The internal conductor 810 of the coaxial cable connector 800 functions as a pin which penetrates the millimeter-wave substrate 500 to connect with a feed end 601 (such as a coaxial line) for use in electricity feeding so as to excite a high-frequency electromagnetic field between the first metal layer 600 and the second metal layer, allowing the high-frequency electromagnetic field to pass through the gap between the first metal layer 600 and the second metal layer and emit outward. The impedance of the millimeter-wave substrate 500 and the impedance of the pin are measured at the feed end 601; and the measured impedance levels depend on the purposes of the antennas. In this regard, the impedance of the millimeter-wave substrate 500 and the impedance of the pin are required to enable the coaxial cable connector bases 700 of the present invention to determine an appropriate "feed position" on the millimeter-wave substrate 500 precisely and easily, so as to ensure the precision of the position of a feed impedance unit of the microstrip antenna structure and thus meet the requirement of impedance matching.

Figure 4:
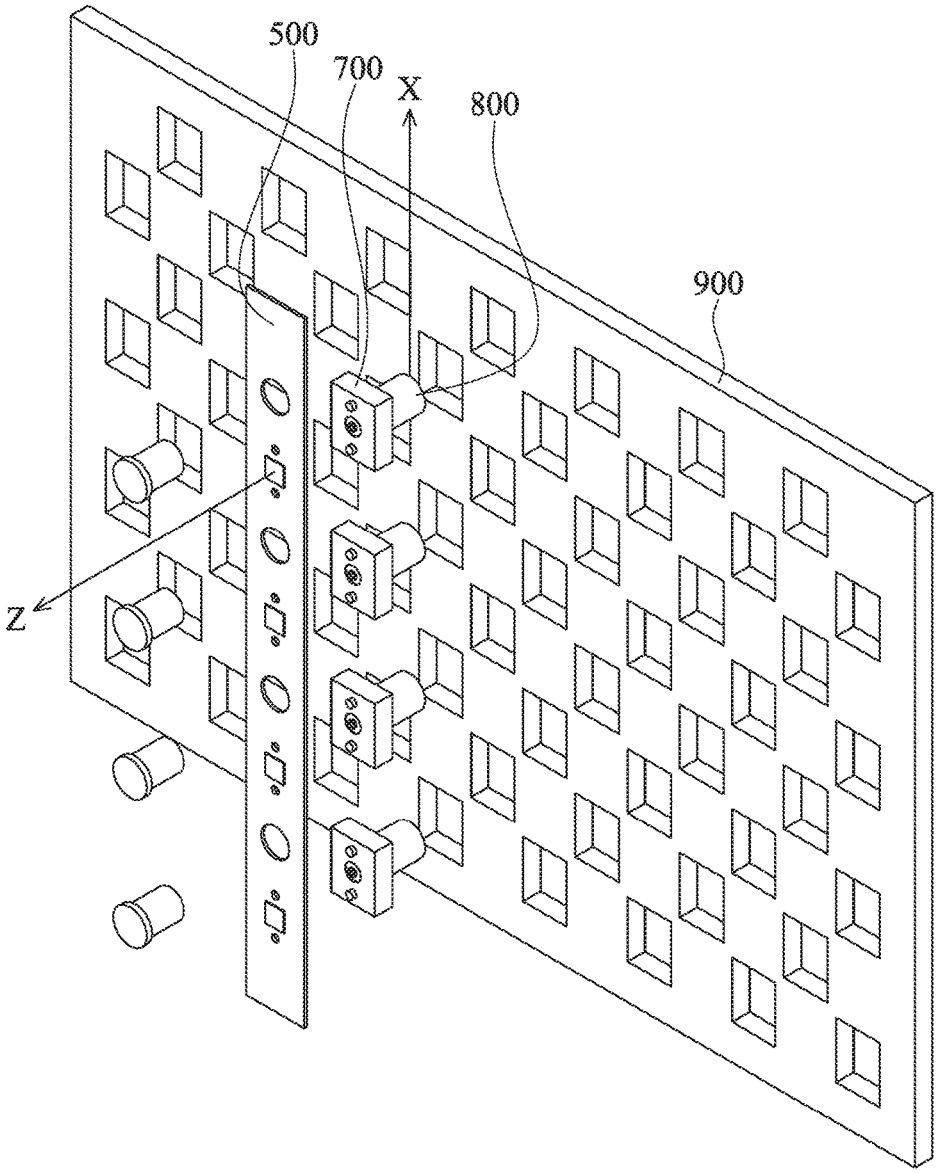
FIG. 4 is an exploded view of the millimeter-wave antenna array device according to the embodiment of the present invention.

Referring to FIG. 4, there is shown an exploded view of the millimeter-wave antenna array device according to the embodiment of the present invention. As shown in the diagram, the millimeter-wave antenna array device comprises an antenna back panel frame 900 and a plurality of millimeter-wave antenna devices. The antenna back panel frame 900 has frame through holes for holding coaxial cable connectors 800. The frame through holes are arranged in columns in a manner that the frame through holes together with the spacing therebetween form a checkerboard-like pattern. The millimeter-wave antenna devices correspond in position to the frame through holes, respectively, and are arranged in columns. RD denotes a radiating patch, DS denotes a dielectric substrate, and CGP denotes a conducting ground plane.

Referring to FIG. 4, the millimeter-wave antenna devices each comprise a millimeter-wave substrate **500*a* and a plurality of coaxial cable connector bases 700. The millimeter-wave substrate 500*a* is a counterpart to the millimeter-wave substrate 500 shown in FIGS. 2, 3** to provide more coaxial cable connector bases and thus form an array-style antenna configuration.

The millimeter-wave substrate **500*a* is a slender board which extends in the column direction. Through holes are penetratingly disposed in the millimeter-wave substrate 500*a* and aligned in the column direction. The millimeter-wave substrate 500*a*** comprises a plurality of microstrip antenna structures formed from metal layers disposed on the upper surface and the lower surface of the millimeter-wave substrate.

Referring to FIGS. 2, 3 and 4, the coaxial cable connector bases 700 each have a recess 720 for holding a coaxial cable connector 800. An internal conductor 810 and an external conductor 820 of the coaxial cable connector 800 are exposed from an opening disposed at the bottom of the recess 720. At least a bump portion 711, 712 is disposed at each coaxial cable connector base 700 and positioned outside the opening. When the top surface of each coaxial cable connector base 700 is coupled to the bottom surface of the millimeter-wave substrate **500*a* (a counterpart to the millimeter-wave substrate 500 shown in FIG. 3), the coaxial cable connector base 700 is received in a corresponding one of the frame through holes; hence, the coaxial cable connector bases 700 are disposed below the millimeter-wave substrate 500*a* and aligned in the column direction. The internal conductor 810 and the external conductor 820, which are exposed from each coaxial cable connector base 700, are electrically connected to a corresponding one of the microstrip antenna structures, whereas the at least a bump portion 711, 712 protrudes into the through holes 521, 522, respectively, to fix the coaxial cable connector bases 700** in place.

Referring to FIG. 4, the bump portions disposed at each coaxial cable connector base 700 and positioned outside the opening of the recess are in the number of two. The millimeter-wave substrate **500*a* has through holes which correspond in position to the two bump portions, respectively. Furthermore, fixing elements are penetratingly disposed in through holes above and below two adjacent through holes corresponding in position to the two bump portions such that the millimeter-wave substrate 500*a* is fixed to the antenna back panel frame 900**.

Figure 5:
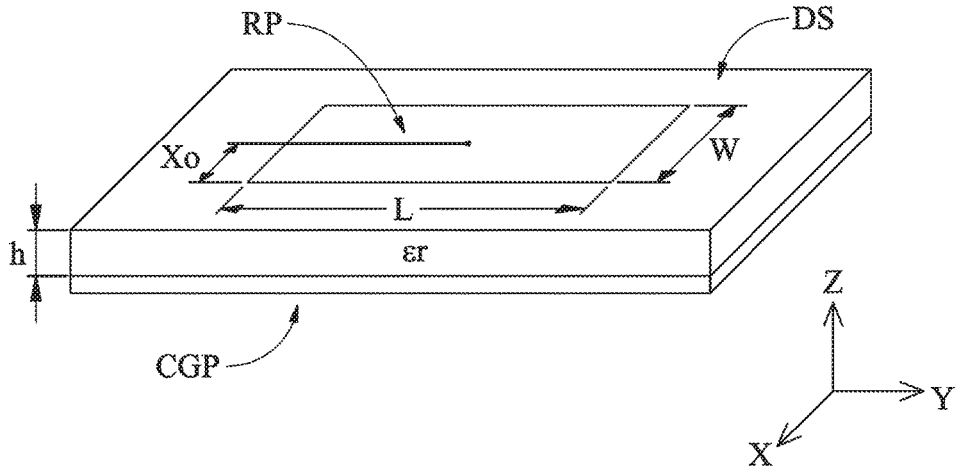
FIG. 5 is a schematic view of patch geometry of the millimeter-wave antenna device according to the embodiment of the present invention.

Referring to FIG. 5, there is shown a schematic view of patch geometry of the millimeter-wave antenna device according to the embodiment of the present invention. The process flow of the operation of the millimeter-wave antenna device is hereunder illustrated with a patch antenna adapted to operate at 38 GHz.

(a) select a millimeter-wave substrate and determine substrate height h and substrate dielectric constant $\varepsilon_r$;

(b) calculate the width of the microstrip line at the frequency f=38 GHz and its equivalent dielectric constant ($\varepsilon_{reff}$) with T-Line or microstrip transmission line design equation;

(c) calculate patch panel width W with equation (1);

$$w = \frac{1}{2f_r\sqrt{\mu_0\varepsilon_0}}\sqrt{\frac{2}{\varepsilon_r+1}} = \frac{v_0}{2f_r}\sqrt{\frac{2}{\varepsilon_r+1}} \tag{1}$$

wherein $v_0$ denotes the speed of light.

(d) calculate the equivalent transmission line length ΔL of a margin field with equation (2);

$$\frac{\Delta L}{h} = 0.412\frac{(\varepsilon_{reff} + 0.3)\left(\frac{w}{h} + 0.264\right)}{(\varepsilon_{reff} - 0.258)\left(\frac{w}{h} + 0.8\right)} \quad (2)$$

(e) determine patch panel length L with equation (3).

$$L = \frac{1}{2f_r\sqrt{\varepsilon_{reff}}\sqrt{\mu_0\varepsilon_0}} - 2\Delta L \quad (3)$$

(f) calculate input impedance with equation (4) to figure out transmission line insertion length Xo such that the input impedance reaches the predetermined impedance value 50Ω.

$$R_{in}(x = x_0) = \frac{1}{2(G_1 + G_{12})}\cos^2\left(\frac{\pi x_0}{L}\right) = R_{in}(x = 0)\cos^2\left(\frac{\pi}{L}x_0\right) \quad (4)$$

$$G_{12} = \frac{1}{120\pi^2}\int_0^{\pi}\left[\frac{\sin\left(\frac{k_0 W}{2}\cos\theta\right)}{\cos\theta}\right]^2 J_0(k_0 L\sin\theta)\sin^3\theta d\theta$$

$$G_1 = \frac{1}{90}\left(\frac{W}{\lambda_0}\right)^2 \quad W << \lambda_0$$

$$G_2 = \frac{1}{120}\left(\frac{W}{\lambda_0}\right) \quad W << \lambda_0$$

(8) perform full-wave simulation analysis of structure size and electrical data by HFSS to figure out the required size.

Figure 6A:
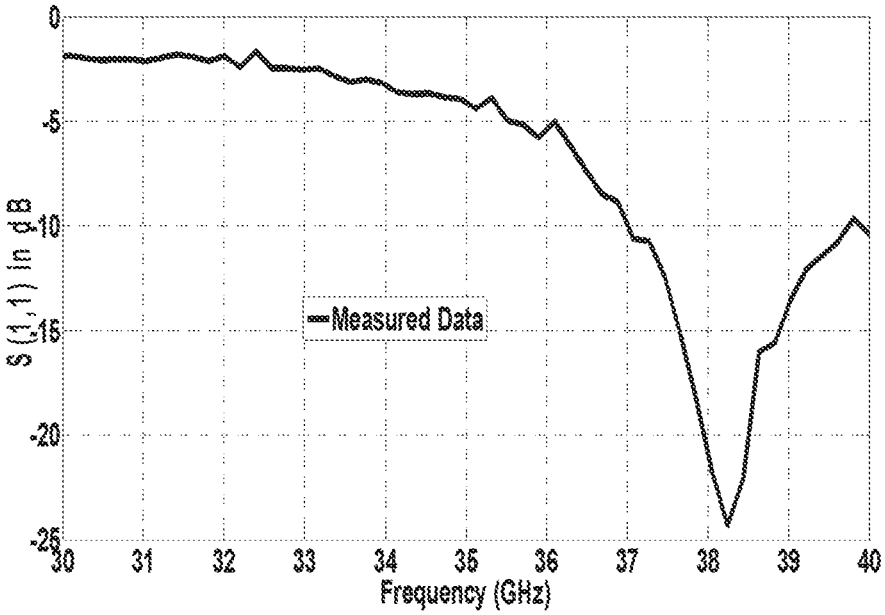
FIG. 6*a* is a graph of the result of a full-wave test conducted by HFSS on the millimeter-wave array antenna device shown in FIG. 5.
Figure 6B:
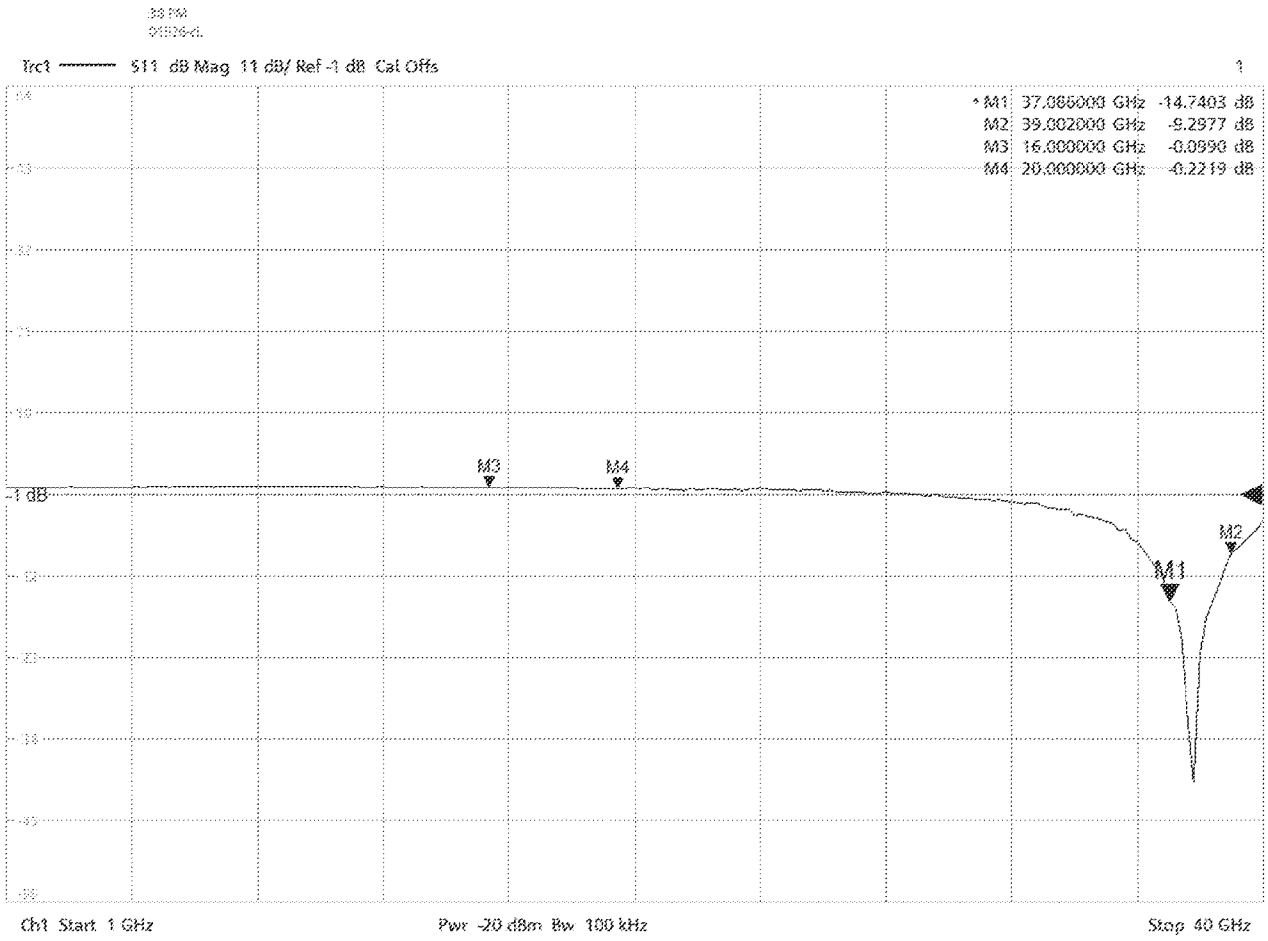
FIG. 6*b* is a graph of the result of a full-wave simulation performed by HFSS on the millimeter-wave array antenna device shown in FIG. 5.

Referring to FIG. 6*a* and FIG. 6*b*, there are shown a graph of the result of a full-wave test conducted by HFSS on the millimeter-wave array antenna device shown in FIG. 5 and a graph of the result of a full-wave simulation analysis performed by HFSS on the millimeter-wave array antenna device shown in FIG. 5, respectively, namely a measured data curve and a simulation curve of the millimeter-wave array antenna device with a microstrip antenna structure. FIG. 6*a* and FIG. 6*b* show that the central frequency of 38 GHz not only exhibits the characteristics of the bandwidth at 1 GHz but also attains advantageously low signal loss, so as to overcome related drawbacks of the prior art as follows: a conventional millimeter-wave circuit incurs high transmission loss and thus causes the deterioration of the reception capability of the system; and a conventional millimeter-wave circuit has overly small physical size to the detriment of mechanism design precision, thereby resulting in frequency deviation and bandwidth insufficiency. In this regard, the present invention puts forth a triangular configuration whereby larger antenna spacing (i.e., 8.5~12 mm) is achieved while meeting the functional requirement of an antenna beam scan, that is, an allowance of ±30 degrees or so; hence, the present invention overcomes a drawback of the prior art, that is, the spacing between antenna units is too small to enable an external emitting/receiving module to function.

The present invention is disclosed above by preferred embodiments. However, persons skilled in the art should understand that the preferred embodiments are illustrative of the present invention only, but should not be interpreted as restrictive of the scope of the present invention. Hence, all equivalent modifications and replacements made to the aforesaid embodiments should fall within the scope of the present invention. Accordingly, the legal protection for the present invention should be defined by the appended claims.

What is claimed is:

1. A millimeter-wave antenna device, comprising:

a millimeter-wave substrate with through holes penetrating disposed therein and aligned in a column direction and a microstrip antenna structure formed from two metal layers disposed on and below the millimeter-wave substrate, respectively; and a coaxial cable connector bases having a recess for holding a coaxial cable connector, wherein an internal conductor and an external conductor of the coaxial cable connector are exposed from an opening disposed at a bottom of the recess, and at least a bump portion is disposed at the coaxial cable connector bases and outside the opening of the recess;

wherein, when a top surface of the coaxial cable connector bases is coupled to a bottom surface of the millimeter-wave substrate, the internal conductor and the external conductor which are exposed from the coaxial cable connector bases are electrically connected to the microstrip antenna structure, and the at least a bump portion protrudes into the through holes, respectively, to thereby fix the coaxial cable connector bases in place;

wherein a metal layer at a middle region of the through holes and on an upper surface of the millimeter-wave substrate functions as a first metal layer of the microstrip antenna structure, and the first metal layer is disposed without going beyond the through holes.

2. The millimeter-wave antenna device of claim 1, wherein the at least a bump portion is in a number of two, and the millimeter-wave substrate has through holes corresponding in position to the two bump portions, respectively.

3. The millimeter-wave antenna device of claim 2, wherein a ground plane is disposed on a lower surface of the millimeter-wave substrate in a manner to correspond in position to the lower region of the first metal layer so as to function as a second metal layer of the microstrip antenna structure.

4. The millimeter-wave antenna device of claim 3, wherein, when a top surface of the coaxial cable connector bases is coupled to a bottom surface of the millimeter-wave substrate, the internal conductor of each coaxial cable connector is inserted into the millimeter-wave substrate and thus electrically connected to the first metal layer, and the external conductor of each coaxial cable connector is electrically connected to the second metal layer.

5. A millimeter-wave antenna array device, comprising:

an antenna back panel frame having frame through holes adapted to hold coaxial cable connectors and arranged in columns in a manner that the frame through holes together with the spacing therebetween form a checkerboard-like pattern; and millimeter-wave antenna devices corresponding in position to the frame through holes, respectively, and arranged in columns, wherein the millimeter-wave antenna devices each comprise:

a millimeter-wave substrate being a slender board extending in a column direction, with through holes penetratingly disposed in the millimeter-wave substrate and aligned in the column direction, and the millimeter-wave substrate comprises a plurality of microstrip antenna structures formed from metal layers disposed on the upper surface and the lower surface of the millimeter-wave substrate; and a plurality of coaxial cable connector bases each having a recess for holding a coaxial cable connector, wherein an internal conductor and an external conductor of the coaxial cable connector are exposed from an opening disposed at the bottom of the recess, wherein at least a bump portion is disposed at the coaxial cable connector bases and positioned outside the opening of the recess, wherein, when a top surface of the coaxial cable connector bases is coupled to a bottom surface of the millimeter-wave substrate, the coaxial cable connector bases are received in the frame through holes, respectively, disposed below the millimeter-wave substrate and aligned in the column direction such that the internal conductor and the external conductor, which are exposed from each coaxial cable connector base, are electrically connected to the microstrip antenna structure, and the at least a bump portion protrudes into the through holes, respectively, to thereby fix the coaxial cable connector bases in place;

wherein a metal layer at a middle region of the through holes corresponding in position to the two bump portions and on an upper surface of the millimeter-wave substrate functions as a first metal layer of the microstrip antenna structure, and the first metal layer is disposed without going beyond the through holes.

6. The millimeter-wave antenna array device of claim 5, wherein the bump portions disposed at each coaxial cable connector base and positioned outside the opening of the recess are in a number of two, and millimeter-wave substrate has through holes which correspond in position to the two bump portions, respectively, wherein fixing elements are penetratingly disposed in through holes above and below two adjacent through holes corresponding in position to the two bump portions such that the millimeter-wave substrate is fixed to the antenna back panel frame.

7. The millimeter-wave antenna array device of claim 6, wherein a ground plane is disposed on a lower surface of the millimeter-wave substrate in a manner to correspond in position to the lower region of the first metal layer so as to function as a second metal layer of the microstrip antenna structure.

8. The millimeter-wave antenna array device of claim 7, wherein, when a top surface of the coaxial cable connector bases is coupled to a bottom surface of the millimeter-wave substrate, the internal conductor of each coaxial cable connector is inserted into the millimeter-wave substrate and thus electrically connected to the first metal layer, and the external conductor of each coaxial cable connector is electrically connected to the second metal layer.

* * * * *